US008302240B2

(12) United States Patent
Tucker et al.

(10) Patent No.: US 8,302,240 B2
(45) Date of Patent: Nov. 6, 2012

(54) SELECTIVELY ADJUSTABLE STEERING MECHANISM FOR USE ON A FLOOR CLEANING MACHINE

(75) Inventors: Steven W. Tucker, Centennial, CO (US); Daniel C. Venard, Centennial, CO (US)

(73) Assignee: Karcher North America, Inc., Englewood, CO (US)

( * ) Notice: Subject to any disclaimer, the term of this patent is extended or adjusted under 35 U.S.C. 154(b) by 630 days.

(21) Appl. No.: 12/511,704

(22) Filed: Jul. 29, 2009

(65) Prior Publication Data

US 2011/0023248 A1 Feb. 3, 2011

(51) Int. Cl.
*A47L 11/00* (2006.01)

(52) U.S. Cl. ..... 15/49.1; 15/50.1

(58) Field of Classification Search ..... 15/49.1–52.2, 15/78, 79.1, 79.2
See application file for complete search history.

(56) References Cited

U.S. PATENT DOCUMENTS

| | | | | |
|---|---|---|---|---|
| 1,596,041 | A | 8/1926 | Young | |
| 1,639,959 | A | 8/1927 | Owen | |
| 1,888,339 | A | 11/1932 | White | |
| 1,900,889 | A | 3/1933 | Becker | |
| 1,995,084 | A | 3/1935 | Wichle | |
| 1,999,696 | A | 4/1935 | Kitto | |
| 2,192,397 | A | 3/1940 | Carlson | |
| 2,263,762 | A | 11/1941 | Dow et al. | |
| 2,668,979 | A | 2/1954 | MacFarland | |
| 2,709,070 | A | 5/1955 | Bielstein | |
| 2,937,881 | A * | 5/1960 | Norrie | 280/775 |
| 3,005,224 | A | 10/1961 | Magarian | |
| 3,020,576 | A | 2/1962 | Gerber | |
| 3,040,363 | A | 6/1962 | Krammes et al. | |
| 3,065,490 | A | 11/1962 | Arones | |
| 3,093,853 | A | 6/1963 | Tamny | |
| 3,193,862 | A | 7/1965 | Lyon | |
| 3,206,787 | A | 9/1965 | Daniels et al. | |
| 3,233,274 | A | 2/1966 | Kroll | |
| 3,284,830 | A | 11/1966 | Kroll | |
| 3,436,788 | A | 4/1969 | Tamny | |
| 3,461,479 | A | 8/1969 | Tierney | |
| 3,504,858 | A | 4/1970 | Liddiard | |
| RE26,950 | E | 9/1970 | Hays | |

(Continued)

FOREIGN PATENT DOCUMENTS

BR PI0511488 1/2008

(Continued)

OTHER PUBLICATIONS

International Search Report for International (PCT) Patent Application No. PCT/US10/42116, mailed Sep. 14, 2010.

(Continued)

*Primary Examiner* — Shay Karls
(74) *Attorney, Agent, or Firm* — Sheridan Ross P.C.

(57) ABSTRACT

A floor cleaning machine is provided that includes a chassis that supports at least one cleaning element. The chassis is supported by a plurality of wheels, one which is steerable via a steering wheel that is interconnected to a housing also associated with the chassis. The chassis provided includes a plurality of movable housing members, one of which is associated with the steering wheel. To access the internal components of the floor cleaning machine, the front housing is rotated or moved away from the other housings wherein the steering wheel does not require disconnection to allow this movement.

9 Claims, 4 Drawing Sheets

U.S. PATENT DOCUMENTS

| | | | | |
|---|---|---|---|---|
| 3,604,051 | A | | 9/1971 | Wendel et al. |
| 3,631,558 | A | | 1/1972 | Kovacevoc |
| 3,705,437 | A | | 12/1972 | Rukauina, Jr. et al. |
| 3,705,746 | A | | 12/1972 | McLeod |
| 3,833,961 | A | * | 9/1974 | Fortman et al. ..... 15/50.3 |
| 3,837,029 | A | | 9/1974 | Kasper |
| 3,846,865 | A | | 11/1974 | Holman |
| 3,879,789 | A | | 4/1975 | Kasper |
| 3,883,301 | A | | 5/1975 | Emrick et al. |
| 3,892,003 | A | | 7/1975 | Peabody |
| 3,896,520 | A | | 7/1975 | Williams |
| 3,927,899 | A | | 12/1975 | Bough |
| 4,010,507 | A | | 3/1977 | Johnson |
| 4,019,218 | A | | 4/1977 | Cyphert |
| 4,037,289 | A | | 7/1977 | Dojan |
| 4,041,567 | A | | 8/1977 | Burgoon |
| 4,046,321 | A | | 9/1977 | Hewett |
| 4,135,669 | A | | 1/1979 | Bridges et al. |
| 4,173,052 | A | | 11/1979 | Burgoon et al. |
| 4,196,492 | A | | 4/1980 | Johnson et al. |
| 4,200,952 | A | | 5/1980 | Smies et al. |
| 4,210,978 | A | | 7/1980 | Johnson et al. |
| 4,214,338 | A | | 7/1980 | Kyle et al. |
| 4,219,901 | A | | 9/1980 | Burgoon et al. |
| 4,293,971 | A | | 10/1981 | Block |
| 4,314,385 | A | | 2/1982 | Wimsatt et al. |
| 4,339,841 | A | | 7/1982 | Waldhauser et al. |
| 4,348,783 | A | | 9/1982 | Swanson et al. |
| 4,354,569 | A | | 10/1982 | Eichholz |
| 4,383,551 | A | | 5/1983 | Lynch et al. |
| D273,621 | S | | 4/1984 | Haub et al. |
| 4,467,494 | A | | 8/1984 | Jones |
| 4,499,624 | A | | 2/1985 | Bloom et al. |
| 4,538,695 | A | | 9/1985 | Bradt |
| 4,572,023 | A | | 2/1986 | Euler |
| 4,586,208 | A | | 5/1986 | Trevarthen |
| 4,596,061 | A | | 6/1986 | Henning |
| 4,654,918 | A | | 4/1987 | Cooper |
| D290,053 | S | | 5/1987 | Block |
| D290,054 | S | | 5/1987 | Block |
| 4,675,935 | A | | 6/1987 | Kasper et al. |
| 4,715,087 | A | | 12/1987 | Todd et al. |
| 4,759,094 | A | | 7/1988 | Palmer et al. |
| 4,805,258 | A | | 2/1989 | Sitarski et al. |
| 4,809,397 | A | | 3/1989 | Jacobs et al. |
| 4,847,944 | A | | 7/1989 | Lackner |
| 4,850,077 | A | | 7/1989 | Venturini |
| 4,879,784 | A | | 11/1989 | Shero |
| 4,920,997 | A | | 5/1990 | Vetter et al. |
| 4,922,575 | A | | 5/1990 | Riemann |
| 5,027,464 | A | | 7/1991 | Knowlton |
| 5,044,043 | A | | 9/1991 | Field et al. |
| 5,054,150 | A | | 10/1991 | Best et al. |
| 5,075,921 | A | | 12/1991 | Gleadall |
| 5,109,566 | A | | 5/1992 | Kobayashi et al. |
| 5,127,124 | A | | 7/1992 | Palmer et al. |
| 5,135,080 | A | | 8/1992 | Haston |
| 5,174,730 | A | | 12/1992 | Niewkamp et al. |
| 5,217,166 | A | | 6/1993 | Schulze et al. |
| 5,221,026 | A | | 6/1993 | Williams |
| 5,245,144 | A | | 9/1993 | Stammen |
| 5,377,376 | A | | 1/1995 | Wood et al. |
| 5,416,949 | A | | 5/1995 | Jute |
| 5,435,038 | A | | 7/1995 | Sauers |
| 5,465,451 | A | | 11/1995 | Stegens |
| 5,465,456 | A | | 11/1995 | Fellhauer et al. |
| 5,485,653 | A | | 1/1996 | Knowlton et al. |
| 5,502,868 | A | | 4/1996 | Braeendle |
| 5,509,162 | A | | 4/1996 | Burgoon |
| D370,320 | S | | 5/1996 | Hachtmann |
| 5,524,320 | A | | 6/1996 | Zachhuber |
| 5,537,712 | A | | 7/1996 | Weber et al. |
| 5,555,595 | A | | 9/1996 | Ligman |
| 5,555,596 | A | | 9/1996 | Knowlton et al. |
| 5,742,975 | A | | 4/1998 | Knowlton et al. |
| 5,785,453 | A | | 7/1998 | Marty et al. |
| 5,802,665 | A | | 9/1998 | Knowlton et al. |
| 5,898,970 | A | | 5/1999 | Straiton |
| 5,901,409 | A | | 5/1999 | Schick et al. |
| 5,943,733 | A | | 8/1999 | Tagliaferri |
| 5,984,031 | A | | 11/1999 | Velke et al. |
| 6,023,813 | A | | 2/2000 | Thatcher et al. |
| 6,030,465 | A | | 2/2000 | Marcussen et al. |
| 6,059,055 | A | | 5/2000 | Velke et al. |
| 6,088,873 | A | | 7/2000 | Pacchini et al. |
| 6,145,855 | A | | 11/2000 | Bellis, Jr. et al. |
| 6,158,084 | A | | 12/2000 | Weber et al. |
| 6,158,673 | A | | 12/2000 | Toetschinger |
| 6,206,980 | B1 | | 3/2001 | Robinson |
| 6,212,731 | B1 | | 4/2001 | Eckerlein |
| 6,230,363 | B1 | | 5/2001 | Kawai et al. |
| 6,266,892 | B1 | | 7/2001 | Haynie |
| 6,283,170 | B1 | | 9/2001 | Robinson |
| 6,338,013 | B1 | | 1/2002 | Ruffner |
| 6,367,120 | B2 | | 4/2002 | Beauchamp |
| 6,397,429 | B1 | | 6/2002 | Legatt et al. |
| 6,425,958 | B1 | | 7/2002 | Giddings et al. |
| 6,431,217 | B2 | | 8/2002 | Robinson |
| 6,442,789 | B1 | | 9/2002 | Legatt et al. |
| 6,450,867 | B1 | | 9/2002 | Legatt |
| 6,453,506 | B1 | | 9/2002 | Sumner |
| 6,464,025 | B1 | | 10/2002 | Koeper et al. |
| 6,484,353 | B2 | | 11/2002 | Rau |
| 6,490,849 | B1 | | 12/2002 | Scag et al. |
| 6,497,422 | B1 | | 12/2002 | Bellis, Jr. et al. |
| 6,502,017 | B2 | | 12/2002 | Ruffner |
| 6,519,808 | B2 | | 2/2003 | Legatt et al. |
| 6,530,821 | B2 | | 3/2003 | Legatt et al. |
| 6,533,871 | B2 | | 3/2003 | Zahuranec et al. |
| 6,535,793 | B2 | | 3/2003 | Allard |
| 6,553,609 | B2 | | 4/2003 | Tremmel et al. |
| 6,554,207 | B2 | | 4/2003 | Ebberts |
| 6,585,827 | B2 | | 7/2003 | Field et al. |
| 6,594,844 | B2 | | 7/2003 | Jones |
| 6,600,981 | B2 | | 7/2003 | Ruffner |
| 6,625,843 | B2 | | 9/2003 | Kim et al. |
| 6,629,333 | B2 | | 10/2003 | Bolden et al. |
| 6,647,585 | B1 | | 11/2003 | Robinson |
| 6,650,975 | B2 | | 11/2003 | Ruffner |
| 6,671,925 | B2 | | 1/2004 | Field et al. |
| 6,681,433 | B1 | | 1/2004 | Ruuska et al. |
| 6,684,452 | B2 | | 2/2004 | Lehman et al. |
| 6,705,332 | B2 | | 3/2004 | Field et al. |
| 6,721,990 | B2 | | 4/2004 | Zahuranec et al. |
| 6,725,512 | B2 | | 4/2004 | Carter et al. |
| 6,735,811 | B2 | | 5/2004 | Field et al. |
| 6,735,812 | B2 | | 5/2004 | Hekman et al. |
| 6,760,947 | B2 | | 7/2004 | Stuchlik |
| 6,772,475 | B2 | | 8/2004 | Weber et al. |
| 6,789,290 | B2 | | 9/2004 | Kent et al. |
| 6,842,940 | B2 | | 1/2005 | Christopher et al. |
| 6,845,829 | B2 | | 1/2005 | Hafendorfer |
| 6,880,199 | B1 | | 4/2005 | Huffman et al. |
| 6,918,156 | B2 | | 7/2005 | Joo et al. |
| 6,918,603 | B2 | | 7/2005 | Boyd |
| 6,941,614 | B2 | | 9/2005 | Montgomery |
| 6,981,338 | B2 | | 1/2006 | Jensen et al. |
| 7,025,835 | B2 | | 4/2006 | Pedlar et al. |
| 7,048,805 | B2 | | 5/2006 | Kent et al. |
| 7,055,201 | B2 | | 6/2006 | Buchegger et al. |
| 7,287,299 | B2 | | 10/2007 | Joynt |
| 7,302,734 | B2 | | 12/2007 | Nowak et al. |
| 7,328,758 | B2 | | 2/2008 | Ruffo |
| 7,370,386 | B2 | | 5/2008 | Lehman et al. |
| 7,430,782 | B2 | | 10/2008 | Ruffo |
| 7,533,435 | B2 | | 5/2009 | Pedlar et al. |
| 7,555,801 | B2 | | 7/2009 | Peters et al. |
| 2002/0116783 | A1 | | 8/2002 | Giddings et al. |
| 2003/0159225 | A1 | | 8/2003 | Kuo |
| 2003/0192963 | A1 | | 10/2003 | Ebberts |
| 2004/0040102 | A1 | | 3/2004 | Field et al. |
| 2004/0172769 | A1 | | 9/2004 | Giddings et al. |
| 2004/0187895 | A1 | | 9/2004 | Field et al. |
| 2004/0221407 | A1 | | 11/2004 | Field et al. |
| 2004/0226578 | A1 | | 11/2004 | Guest et al. |
| 2004/0226584 | A1 | | 11/2004 | Guest et al. |
| 2005/0251937 | A1 | | 11/2005 | Ruffo |

| | | | |
|---|---|---|---|
| 2005/0251948 | A1 | 11/2005 | Ruffo |
| 2005/0252186 | A1 | 11/2005 | Ruffo |
| 2006/0064844 | A1 | 3/2006 | Venard et al. |
| 2006/0124770 | A1 | 6/2006 | Vernard et al. |
| 2006/0156498 | A1 | 7/2006 | Vernard et al. |
| 2009/0094784 | A1 | 4/2009 | Pedlar et al. |

FOREIGN PATENT DOCUMENTS

| | | |
|---|---|---|
| CA | 2242793 | 5/1999 |
| CA | 2268234 | 10/1999 |
| DE | 1270066 | 6/1968 |
| DE | 1658384 | 4/1971 |
| DE | 69011648 | 12/1994 |
| DE | 9421472 | 1/1996 |
| DE | 4429996 | 2/1996 |
| DE | 9421625 | 3/1996 |
| DE | 19539350 | 4/1997 |
| DE | 19745887 | 4/2000 |
| DE | 19851681 | 5/2000 |
| DE | 19851666 | 9/2000 |
| DE | 69608989 | 11/2000 |
| DE | 19927593 | 4/2001 |
| DE | 10029691 | 4/2002 |
| DE | 10030725 | 4/2002 |
| DE | 10062329 | 7/2002 |
| DE | 20204485 | 10/2002 |
| DE | 10142192 | 3/2003 |
| DE | 10204118 | 10/2003 |
| DE | 10218244 | 11/2003 |
| DE | 10221349 | 11/2003 |
| DE | 10221351 | 11/2003 |
| DE | 10221352 | 11/2003 |
| DE | 10307150 | 9/2004 |
| DE | 10324825 | 12/2004 |
| DE | 10324826 | 12/2004 |
| EP | 0017913 | 4/1983 |
| EP | 0282850 | 3/1988 |
| EP | 0281976 | 9/1988 |
| EP | 0283022 | 9/1988 |
| EP | 0176696 | 4/1989 |
| EP | 0176697 | 5/1990 |
| EP | 0569430 | 11/1994 |
| EP | 0421194 | 6/1995 |
| EP | 0792615 | 9/1997 |
| EP | 0189617 | 8/1998 |
| EP | 0867331 | 9/1998 |
| EP | 1023867 | 6/1999 |
| EP | 0951857 | 10/1999 |
| EP | 1108092 | 6/2001 |
| EP | 1164074 | 12/2001 |
| EP | 1260129 | 11/2002 |
| EP | 1265713 | 12/2002 |
| EP | 01108091 | 10/2004 |
| EP | 1335869 | 10/2004 |
| EP | 1604605 | 12/2005 |
| GB | 2338686 | 12/1999 |
| JP | 08-182638 | 12/1994 |
| JP | 08-196496 | 1/1995 |
| JP | 07-047039 | 7/1996 |
| JP | 2001-258807 | 9/2001 |
| JP | 2002-078650 | 3/2002 |
| JP | 2005/324020 | 11/2005 |
| WO | WO 86/01240 | 2/1986 |
| WO | WO 89/06624 | 7/1989 |
| WO | WO 92/13480 | 8/1992 |
| WO | WO 86/02394 | 4/1996 |
| WO | WO 97/15730 | 5/1997 |
| WO | WO 97/15731 | 5/1997 |
| WO | WO 00/28149 | 5/2000 |
| WO | WO 00/79058 | 12/2000 |
| WO | WO 01/05216 | 1/2001 |
| WO | WO 01/41935 | 6/2001 |
| WO | WO 02/42184 | 5/2002 |
| WO | WO 2005/079468 | 9/2005 |

OTHER PUBLICATIONS

Written Opinion for International (PCT) Patent Application No. PCT/US10/42116, mailed Sep. 14, 2010.
"Minny 16," FIMAP, Italian Customized Cleaning, 2007, 8 pages.
"Schmidt Produkte: Kleinkehrfahrzeug GALOPIO", Photo of Galopio device, available at http://database.schmidtgroup.net/loader.php//en/schmidt/swk/products/00011/picture1.html, as early as Apr. 29, 2003, printed on Jan. 29, 2007 1 page.
"Scmidt Produkte: Kleinkehrfahrzeug GALOPIO", Photo of Galopio device with description, available at http://database.schmidtgroup.net/loader.php/de/schmidt/swk/00011/, as early as May 29, 2003, printed on Jan. 29, 2007, p. 1.
"The Science of Floor Care: Profi™ Rubber Floor Cleaner/Degreaser," Taski, http://www.johnsondiversey.com/Cultures/en-US-OpCo/Products+and+Systems/Categori . . . , accessed Nov. 12, 2008, 2 pages.
Fantomat Sale Sheet, BUZILI-WERK Wagner GmbH & Co.
GALOPIO Cleaning Device, www.schmidt-holding.com, accessed Feb. 23, 2005, 4 pages.
Galopio Operating Instructions, Schmidt Winterdienst-Und Kommunaltechnik, Jan. 17, 2005, Issue 5, pp. 1-84.
Hefter Cleantech, Convert 82, May 19, 2006, 3 pages, accessed Jun. 1, 2007.
Kärcher, MC600 Multicleaner Brochure, date unknown, 2 pages.
Kärcher, MC600 Multicleaner Brochure, date unknown, 4 pages.
Kärcher, Multicleaner MC600 Manual, date unknown, 44 pages.
Kärcher, Multicleaner MC600, Mar. 1990, 7 pages.
Kärcher, NT301 Brochure, date unknown, 2 pages.
Kärcher, Worldwide Cleaning Expertise Programme 91/92, published more than one year prior to the filing date of U.S. Patent 6,425,958, which was filed Feb. 2001, 50 pages.
Nobles Typhoon 161OP/1612 Wet/Dry Vacuum Operator and Parts Manual, Jan. 2000, 22 pages Kaivac, Inc.
No-Touch Cleaning Brochure, Kaivac, Inc., dated 2003, 8 pages.
Photo and information related to Galopio device sold on Mascus website, available at http://www.mascus.com/product_card.asp?br=Broddway&catn=Groundscare&page=1&location=EN&pr . . . , indicates that device was registered in 2000, printed on Jan. 29, 2007, p. 1.
Photo of Galopio device, available at http://www.bassewitz.de/fahrzeuge/schmidt.htm, as early as Jan. 26, 2002, printed on Jan. 29, 2007, pp. 1-2.
Print out of Kaivac No-Touch Clean System, www.Kaivac.com, dated Jan. 23, 2003, 3 pages.
Print out of Nilfisk Aquatron 8 machine, www.mn.nilfisk-advance.com, dated Jan. 30, 2003, 1 page.
Service Master, Boss 2000B Manual, Oct. 1995, 42 pages.
Service Master, Boss 2000E Manual, Aug. 1997, 32 pages.
Service Master, Boss 2000LE Manual, Mar. 1998, 30 pages.
Warning: Your Competitor has a KaiVac, Sep. 1998, 10 pages.
International Preliminary Report on Patentability for International (PCT) Patent Application No. PCT/US2010/042116, mailed Feb. 9, 2012 7 pages.

* cited by examiner

SELECTIVELY ADJUSTABLE STEERING MECHANISM FOR USE ON A FLOOR CLEANING MACHINE

FIELD OF THE INVENTION

The present invention is generally related to floor cleaning machines. More specifically, one embodiment of the present invention is a floor cleaning machine that includes a steering mechanism with a flexible telescoping portion. The flexible telescoping portion accommodates movement of a housing to which it is associated to allow easy access to interior portions of the device.

BACKGROUND OF THE INVENTION

Floor cleaning machines generally of the walk behind or ride on variety are comprised of a chassis supported by a plurality of wheels, one of which is steerable to control the path of the machine. The chassis also accommodates the cleaning apparatus, such as a brush(s), a squeegee, a burnisher, for example (hereinafter "cleaning apparatus"). The steerable wheel is interconnected to a steering wheel, or joy stick, by way of a steering mechanism comprised of various gears. The chassis also supports tanks used to hold water cleaning fluids and spent cleaning fluids suctioned from the floor. The majority of the components associated with the cleaning machine are surrounded by at least one housing which protects the internal components from the environment and protects individuals that are working around the machine from touching the often hot internal components. As floor cleaning machines are often used in tight spaces, such as bathrooms and hallways, it is desirable to make floor cleaning machines as compact as possible.

It is also desirable to provide floor cleaning machines that allow for easy access to internal componentry for maintenance and repair thereof. Unfortunately, the desire for easy access is often at odds with the desire to provide a compact apparatus. Specifically, prior art machines are constructed in such a way that the internal volume thereof is minimized, providing a compact machine, but leaving virtually no easy access to internal componentry. In order to address this disadvantage, some prior art machines utilize removable segments to the housing that cover internal components. Often, however, external components, such as steering wheels, control panels, external storage tanks, etc., must be removed prior to removal of these housing segments. Removal of the external componentry as well as the housing segments technology is time consuming, costly, and increases the chance that the machine will be damaged or a component of the machine will be lost.

Thus there is a long felt need to provide a floor cleaning machine that is compact yet allows easy access to the internal components thereof without requiring disassembly of portions of the floor cleaning machine. The following disclosure describes an improved floor cleaning machine that includes a plurality of movable housings that are associated with external components that do not require removal prior to removal or movement of the housings. Thus a highly compact, yet serviceable floor cleaning machine is provided, as will be described below.

SUMMARY OF THE INVENTION

It is one aspect of the embodiment of the present invention to provide a floor cleaning machine that includes a chassis that is supported by a plurality of wheels, one of which is steerable. The steerable wheel is associated with a steering mechanism that is also associated with the chassis. The steering mechanism generally may employ a plurality of gears that transfer rotational inputs from a steering wheel to rotation of the gears that ultimately alter the angle of the steerable wheel or wheels. The chassis also supports floor cleaning apparatus, such as brushes, squeegees, spray nozzles, etc., all of which are described in, for example, U.S. Pat. No. 7,533,435 entitled "Floor Treatment Apparatus", which is incorporated by reference in its entirety herein.

The internal components of the floor cleaning machine, such as pumps, vacuums, storage tanks, tubes, electrical hardware, batteries, etc. are stored within a housing, which generally defines the outer envelope of the floor cleaning device. The housing directs cooling air around certain components of the floor cleaning device, protects individuals from gaining accidental access to hazardous areas of the floor cleaning device and protects internal components of the floor cleaning device from environmental damage. In one embodiment of the present invention, the housing may be comprised of a primary housing directly interconnected to the chassis. The primary housing may have a plurality of removable segments that allow selective access to the interior of the floor cleaning device or may be of one piece construction that surrounds all internal components of the floor cleaning machine. The primary housing may be removable from the chassis in any number of ways known in the art. A front housing is rotatably interconnected to at least one of the primary housing or the chassis and is thus capable of transitioning away from the primary housing to allow access to internal components covered thereby, both from above and from the front of the floor cleaning machine. Finally, a rear housing is provided that may also be rotatably interconnected to the chassis and/or primary housing. The housing segment is also selectively rotatable from the primary housing to allow access to internal components covered thereby, both from the rear and top of the floor cleaning machine.

The front housing of one embodiment of the present invention accommodates various controls associated with the floor cleaning machine. These controls may indicate the amount of cleaning and spent fluid in the tanks, control power, battery life, etc. The front housing also accommodates a steering wheel that allows the operator to selectively control the movement of the floor cleaning machine. The steering wheel is interconnected to a steering mechanism by a shaft. Rotation of the steering wheel causes the connected shaft to similarly rotate, ultimately causing a change to the angle of the steerable wheel.

The steering shaft of one embodiment of the present invention is able to move as the housing rotates without requiring disconnection from the steering mechanism or removal of the steering wheel. The shaft of one embodiment includes a stationary rigid portion that is slidably interconnected to a flexible portion that selectively slides over the rigid portion and flexes when the front housing is rotated away from the primary housing. More specifically, in order to also accommodate the movement of the shaft, a slip fitting is preferably interconnected to the flexible portion to allow the steering shaft to separate from the chassis, by sliding over the rigid portion, while remaining interconnected to the steering mechanism.

The rear housing of one embodiment of the present invention may accommodate a tank that stores at least one of clean water or waste water. In one embodiment, the tank is capped prior to rotating it away from the primary housing to avoid spillage of the tank contents. One advantage of some embodiments of the present invention described herein, is that a compact floor cleaning machine is provided that allows for easy and selective access to internal components of the machine without having to remove the machine housing, a timely and thus costly process.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
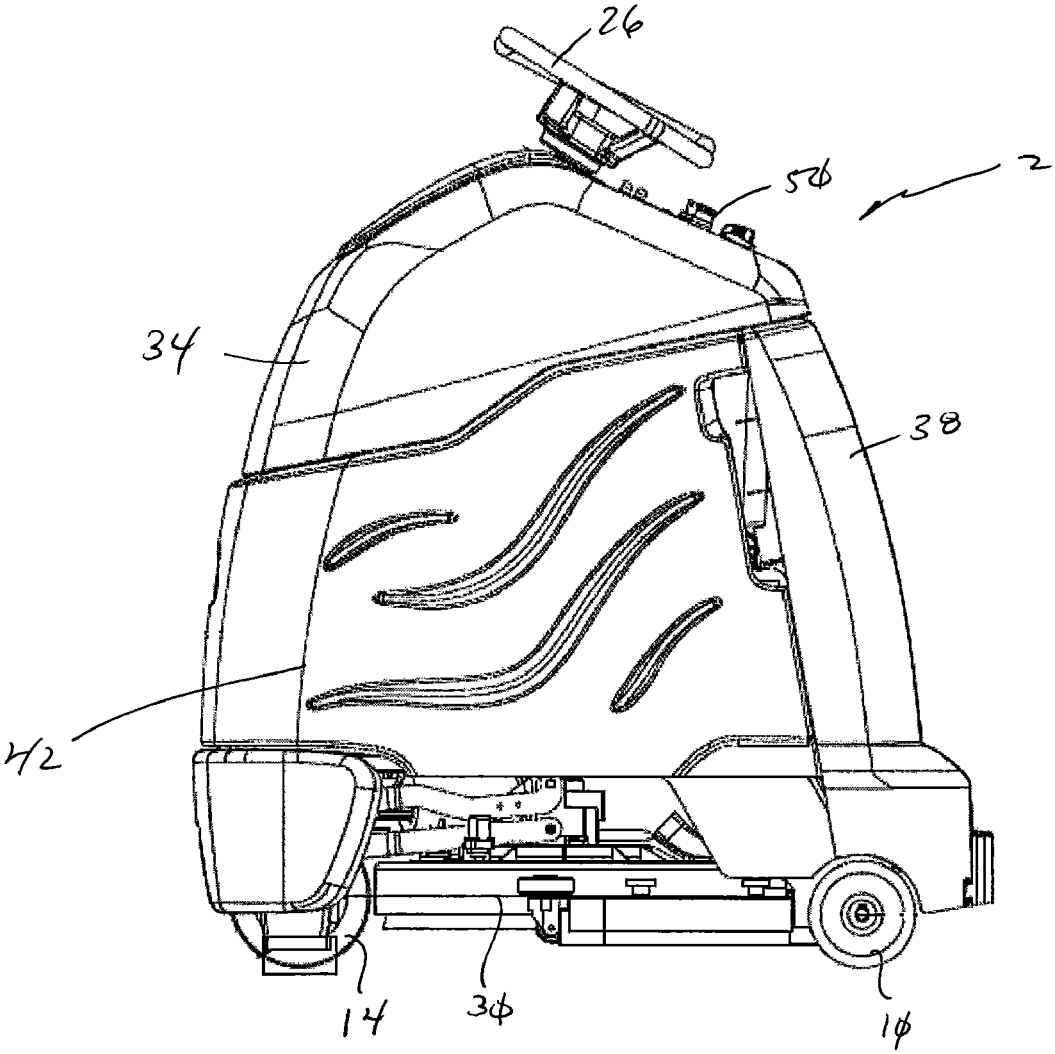
FIG. 1 is a front elevation view of the floor cleaning machine of one embodiment of the present invention.

To assist in the understanding of one embodiment of the present invention the following list of components and associated numbering found in the drawings is provided herein:

| # | Components |
|---|---|
| 2 | Floor cleaning machine |
| 6 | Chassis |
| 10 | Rear wheel |
| 14 | Front wheel |
| 18 | Steering mechanism |
| 22 | Steering shaft |
| 26 | Steering wheel |
| 30 | Cleaning apparatus |
| 34 | Front housing |
| 38 | Rear housing |
| 42 | Primary housing |
| 46 | Vacuum motor |
| 50 | Control panel |
| 54 | Front hinge |
| 58 | Rear hinge |
| 62 | Tank |
| 66 | Rigid portion |
| 70 | Slip fitting |
| 74 | Flexible portion |
| 78 | Shaft |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
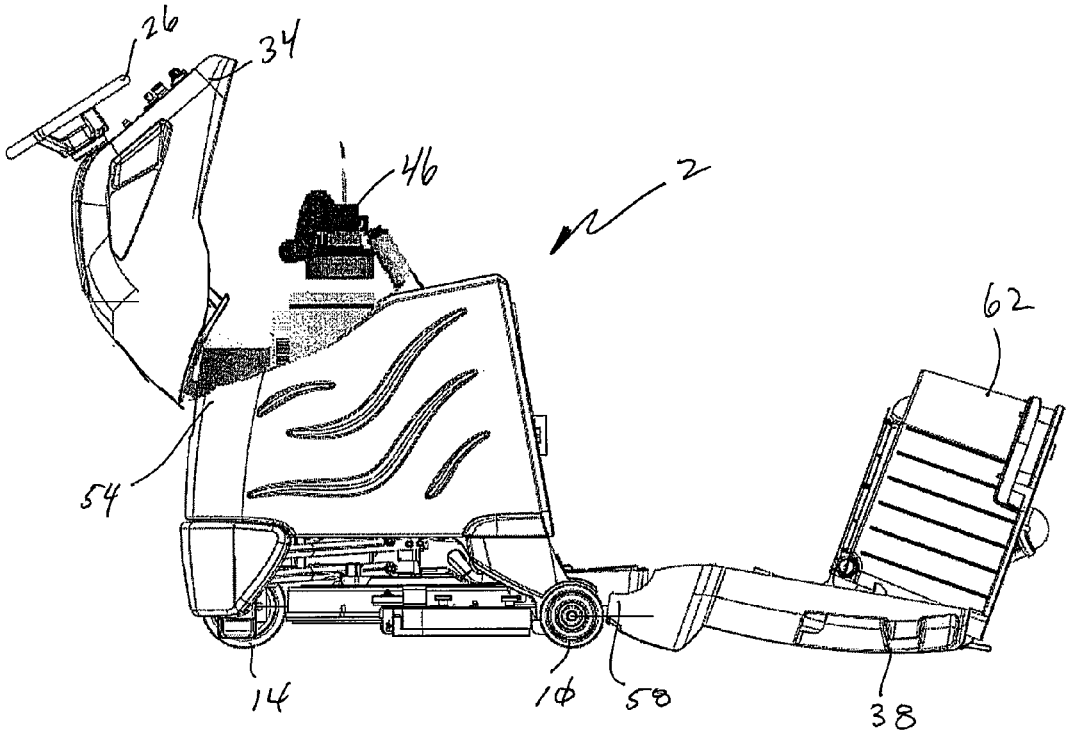
FIG. 2 is a front elevation view of FIG. 1 wherein a front housing and a rear housing have been rotated from a primary housing of the floor cleaning machine.

Referring now to FIGS. 1-4, a floor cleaning machine 2 of one embodiment of the present invention is shown that is generally comprised of a chassis 6 that is supported by two rear wheels 10 and a steerable front wheel 14. The front wheel 14 is associated with a steering mechanism 18 that is also interconnected to the chassis 6. A steering shaft 22 (FIGS. 3 and 4 only) is interconnected to the steering mechanism 10 and terminates at a steering wheel 26. The chassis 6 also supports at least one cleaning apparatus 30 (FIG. 1) and a plurality of housings. Two of the housings, a front housing 34 and a rear housing 38, are capable of rotating away from a primary housing 42 to provide access to interior components of the floor cleaning machine 2, such as a vacuum motor 46 (FIG. 2). The steering wheel 26 is also associated with the front housing 34 and remains interconnected thereto when the front housing 34 is rotated away from the primary housing 42 (FIG. 2). The steering shaft 22 of one embodiment of the present invention is thus flexible and is capable of moving away from the chassis 6 while remaining interconnected to the steering mechanism 18.

Referring now to FIG. 1, the floor cleaning machine 2 of one embodiment of the present invention is shown. Here, the front housing 34 is connected to a front portion of the primary housing (42) and accommodates a control panel 50 and the steering wheel 26. The rear housing 38 is also interconnected to the primary housing 42 and encloses hoses, mechanical and electrical components of the machine. The front wheel 14, which is steerable, and the rear wheel 10 (a second rear wheel is not shown but positioned on the opposite side of the machine) which generally is not steerable, is associated with the chassis. The cleaning apparatus 30, such as a cleaning brush and a squeegee, is also associated with the chassis. One skilled in the art will appreciate that the cleaning apparatus may be a brush, a scrubber, a burnisher, a squeegee, a spray nozzle, spent fluid pick-up mechanism etc., some of which are described in detail in the patent described in previously incorporated U.S. Pat. No. 7,533,435.

Referring now to FIG. 2, the floor cleaning machine 2 of one embodiment of the present invention is shown in a second configuration. Here, the front housing 34 and rear housing 38 have been rotated away from the primary housing 42 to expose internal components of the floor cleaning machine 2. Here, the steering wheel 26 and control panel 50 are moved along with the front housing 34. The connections associated with the control panel 50 and the steering wheel 26, i.e. the steering shaft 22, remain associated with the chassis 6, which will be described in further detail with respect to FIGS. 3 and 4. The internal components, such as a vacuum motor 46 are thus exposed to be maintained or repaired. The front housing 34 of the embodiment shown, is hingedly interconnected to the primary housing 42 by way of a front hinge 54. One skilled in the art will appreciate, however, that the front housing 34 may rotatably interconnect directly to the chassis 6. The rear housing 38 is rotatably interconnected to the chassis 6 by way of a rear hinge 58 and accommodates in one embodiment a storage tank 62. Those in the art will also appreciate that the rotatable housings could be rotated in virtually any direction desired which would best facilitate the objects of the benefits of the disclosed inventive features.

Figure 3:
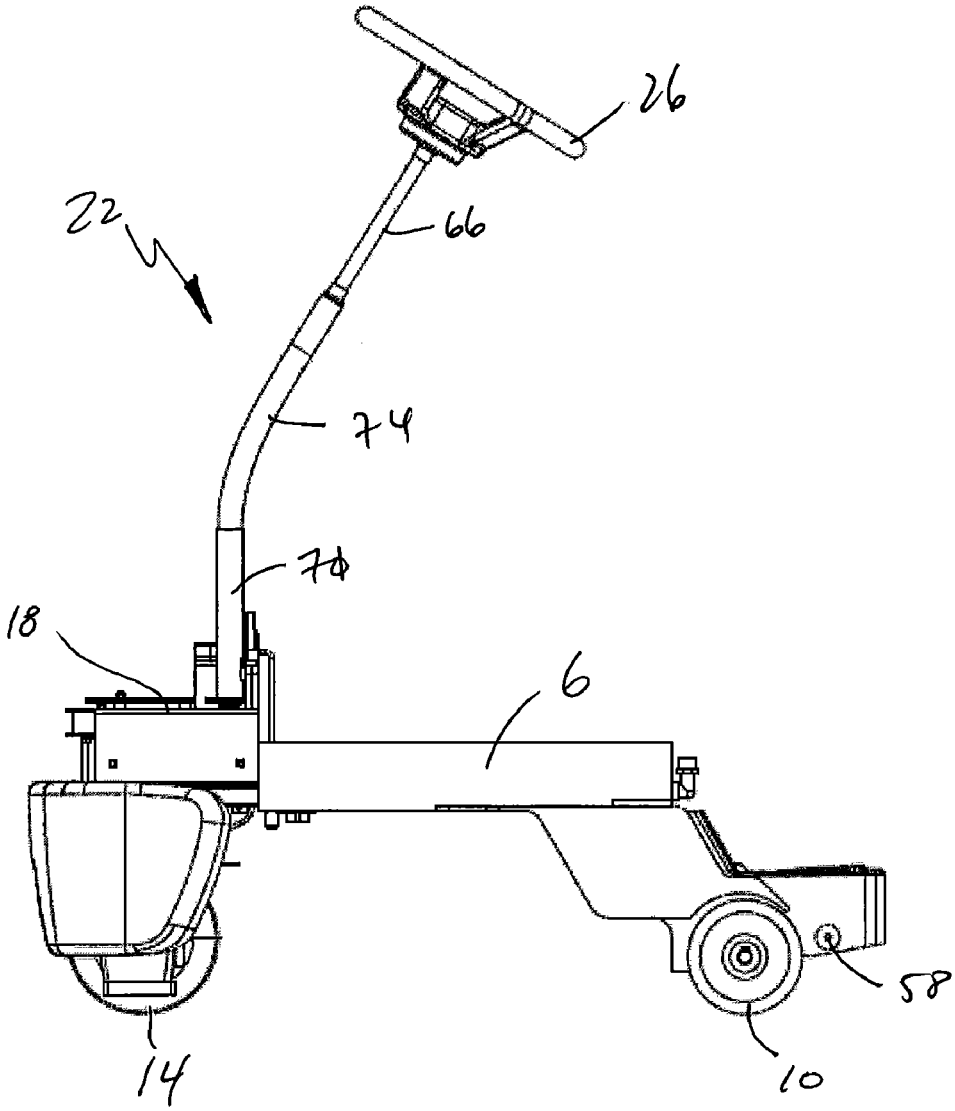
FIG. 3 is a front elevation view of the floor cleaning device showing a chassis, a steering shaft and steering wheel, the aforementioned housing has been removed for clarity.
Figure 4:
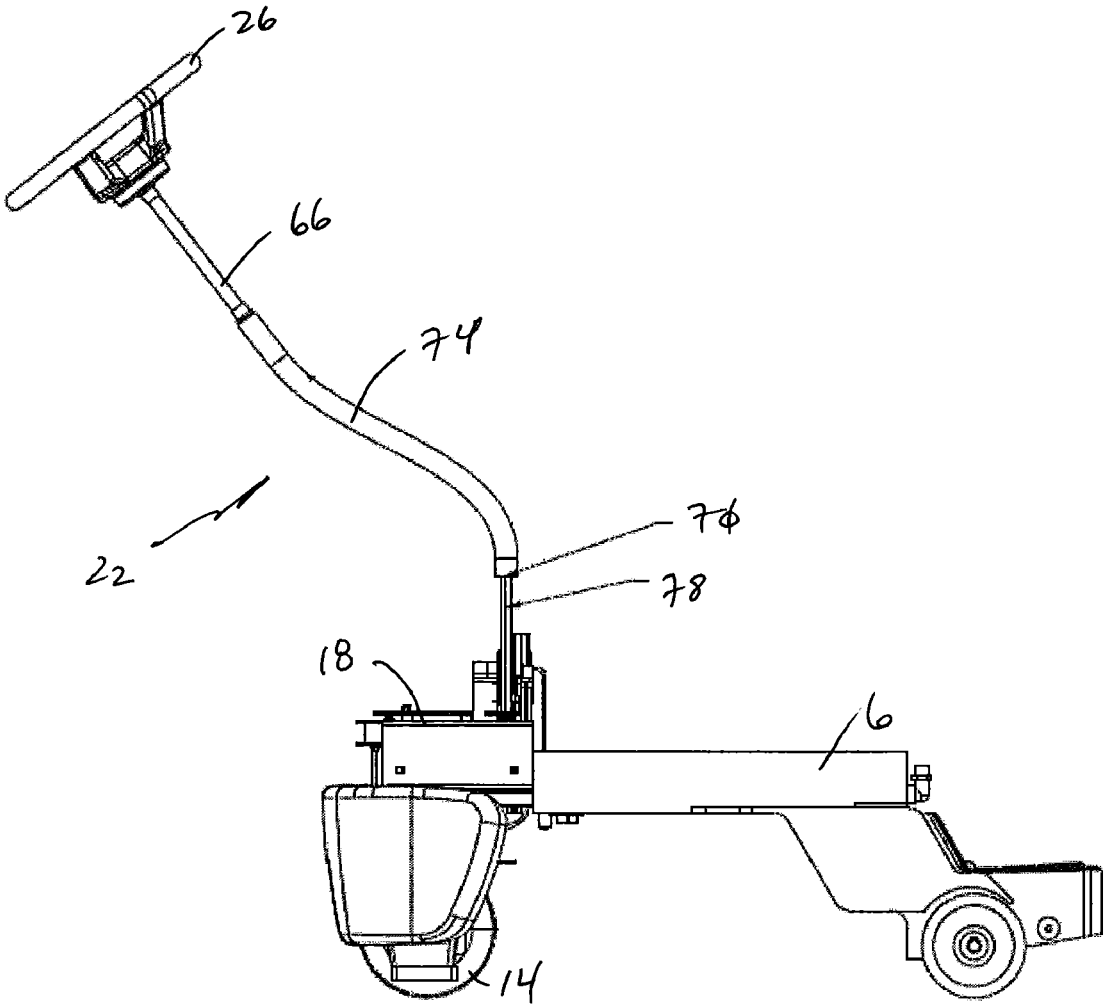
FIG. 4 is a front perspective view similar to that of FIG. 3 wherein the steering wheel has been moved to a second position.

Referring now to FIGS. 3 and 4, the nature of the steering shaft 22 is shown, with the remainder of the components shown in FIGS. 1 and 2 having been removed for clarity. The steering shaft 22 may be comprised of a rigid portion 66, that is interconnected to the steering wheel 26 and a slip fitting 70, with a flexible portion 74 therebetween. Rotation of the steering wheel 26 will thus rotate the rigid portion 66, which will rotate the flexible portion 74 and the slip fitting 70, which will ultimately rotate the front wheel 14 to allow steering of the floor cleaning machines.

Referring specifically to FIG. 4, the steering wheel 26 is shown in a second position of use, where the front housing has been rotated away from the primary housing (see FIG. 2). Here, one can quickly appreciate that when rotated, the flexible portion 74 will flex to allow the steering wheel to be maintained with the front housing. In addition, the slip fitting 70 will move upwardly away from the chassis 6. The slip fitting 70 is slidingly interconnected to a shaft 78 that is interconnected to at least one mechanism, such as a gear or belt, that rotates the steerable front wheel 14. As those in the art will appreciate the shaft 8 could also be directly connected to the steering wheel assembly.

In one embodiment, the shaft 78 is hexagonal and cooperates with a hexagonal opening in the slip fitting 70 to allow rotation of the steering wheel 26 to be translated to the steerable shaft 22 to allow the rotation of the steerable front wheel 14. One skilled in the art will appreciate, however, that any configuration that provides rotational locking between the slip fitting 70 and the shaft 78 that would allow for rotation of the shaft 78 upon rotation of the slip fitting 70 is within the scope of the disclosure.

The flexible portion 74 may be constructed of nylon impregnated rubber or any other compliant or flexible material. Alternatively, a wire overwrapped flexible bellows member may be used instead of a composite rubber member. Further, in order to facilitate rotational translation of the steering wheel 26 to the steering mechanism, the flexible portion 74 may be comprised of a rubber tube wrapped by a flexible metal coil. Additionally, one of skill in the art will appreciate that a bellows system may be used wherein the slip fitting 70 is omitted and the bellows would be directly interconnected to the steering mechanism 18 and thus would allow for bending of the steering shaft 22 and selective elongation thereof if needed. One skilled in the art will appreciate the various systems that may be used to achieve the goal of providing at least one of flexibility in the steering assembly and/or elongation thereof to accommodate the moving of the front housing.

In one embodiment of the present invention the flexible portion 74 is made of steel reinforced rubber and is about 22 inches long. In addition, the steering shaft 78 is 9 inches long and has a hexagonal exterior configuration that fits into a hexagonal opening of the slip fitting 70. One skilled in the art will also appreciate that the shaft 78 may be hollow such that the slip fitting 70 fits within the shaft 78, for example.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A floor cleaning machine, comprising:

a primary housing;

a front housing rotatably associated with the primary housing by way of a first hinge such that the front housing is capable of rotating away from primary housing;

a rear housing rotatably associated with the primary housing by way of a second hinge such that the rear housing is capable of rotating away from the primary housing;

a steering mechanism associated with the front housing;

a steering shaft interconnected between the steering wheel and a chassis, wherein when the front housing is rotated from the primary housing, the steering shaft flexes and moves coincident with the movement of the front housing such that the steering wheel remains associated with the chassis;

said steering shaft is comprised of an elongated rigid portion that is interconnected to a steering wheel on a first end and to a flexible portion on a second end;

the flexible portion having a first end that is interconnected to the elongated rigid portion an a second end that is open and that leads to a hollow portion of the flexible portion;

a shaft having a first end associated with the steering mechanism and a second end operably interconnected to the second end of the flexible portion; and wherein the steering shaft extends between a first length and a second length, the first length is wherein the second end of the shaft and the second end of the flexible portion are positioned adjacent to each other wherein the shaft is received within the hollow portion of the flexible portion and the second length is wherein the first end of the shaft and the second end of the flexible portion are positioned adjacent to each other.

2. The floor cleaning machine of claim 1, wherein the flexible portion has a slip fitting on the second end thereof that is slidingly interconnected to the shaft.

3. The floor cleaning machine of claim 2, wherein the shaft of the steering mechanism has a hexagonal outer surface that interacts with a hexagonal hole in the slip fitting.

4. The floor cleaning machine of claim 1, further comprising a floor cleaning apparatus associated with the chassis.

5. The floor cleaning machine of claim 1, wherein the second hinge is located closer to a rear wheel of the floor cleaning machine than a front wheel of the floor cleaning machine.

6. A floor cleaning machine, comprising:

a primary housing;

a front housing rotatably interconnected to the primary housing by way of a first hinge such that the front housing is capable of rotating relative to the primary housing;

a rear housing rotatably interconnected to the primary housing by way of a first hinge such that the rear housing is capable of rotating relative to the primary housing;

a means for steering associated with the front housing; and an interconnecting member associating the means for steering with a chassis, wherein when the front housing is rotated from the primary housing, the interconnecting member flexes and moves coincident with the movement of the front housing such that the means for steering remains associated with the chassis;

the interconnecting member includes a means for steering comprising an elongated rigid portion that is interconnected to a steering wheel on a first end and to a flexible portion on a second end;

the flexible portion having a first end that is interconnected to the elongated rigid portion an a second end that is open and that leads to a hollow portion of the flexible portion;

a shaft having a first end associated with the steering mechanism and a second end operably interconnected to the second end of the flexible portion;

wherein the steering shaft extends between a first length and a second length, the first length is wherein the second end of the shaft and the second end of the flexible portion are positioned adjacent to each other wherein the shaft is received within the hollow portion of the flexible portion and the second length is wherein the first end of the shaft and the second end of the flexible portion are positioned adjacent to each other.

7. The floor cleaning device of claim 6, wherein the flexible portion has a slip fitting on the second end thereof that is slidingly interconnected to the shaft.

8. The floor cleaning machine of claim 7, wherein the shaft of the steering mechanism interacts with a hexagonal hole in the slip fitting.

9. The floor cleaning machine of claim 6, further comprising a floor cleaning apparatus associated with the chassis.

* * * * *